US005201999A

United States Patent [19]

Field et al.

[11] Patent Number: 5,201,999

[45] Date of Patent: Apr. 13, 1993

[54] TWIN WIRE FORMING APPARATUS

[75] Inventors: Roderic Field, Bury, England; John W. Harwood, Janesville, Wis.; Peter Jackson, Bury, England

[73] Assignee: Beloit Technologies, Inc., Wilmington, Del.

[21] Appl. No.: 713,186

[22] Filed: Jun. 10, 1991

[51] Int. Cl.[5] ..... D21F 1/00

[52] U.S. Cl. ..... 162/301; 162/203; 162/352

[58] Field of Search ..... 162/203, 300, 301, 303, 162/352

[56] References Cited

U.S. PATENT DOCUMENTS

| | | | |
|---|---|---|---|
| 3,847,731 | 11/1974 | Arledter | 162/301 |
| 3,944,464 | 3/1976 | Means | 162/273 |
| 4,125,428 | 11/1978 | Phelps | 162/301 |
| 4,153,504 | 5/1979 | Justus | 162/301 |
| 4,414,061 | 11/1983 | Trufitt et al. | 162/301 |
| 4,557,802 | 12/1985 | Waris | 162/301 |
| 4,609,435 | 9/1986 | Tissari | 162/211 |
| 4,790,909 | 12/1988 | Harwood | 162/301 |
| 4,830,709 | 5/1989 | Turner et al. | 162/301 |
| 5,034,098 | 7/1991 | Hergert | 162/301 |

FOREIGN PATENT DOCUMENTS

| | | |
|---|---|---|
| 9009481 | 8/1990 | World Int. Prop. O. . |
| 9102842 | 3/1991 | World Int. Prop. O. . |
| 9113206 | 9/1991 | World Int. Prop. O. . |

*Primary Examiner*—Karen M. Hastings

*Attorney, Agent, or Firm*—Dirk J. Veneman; Raymond W. Campbell; David J. Archer

[57] ABSTRACT

A twin wire forming apparatus for forming a web from stock having an ash content above 20% has upstream end disposed closely adjacent to a headbox. A curved shoe cooperates with a second wire and is immediately downstream relative to the upstream end of the forming section. The second wire is between a first wire and the shoe, so that a first portion of water is removed through the first wire when the wires and the stock move over the shoe. A dewatering device is between the shoe and the downstream end of the forming section and cooperates with the first wire and is on the opposite side of the wires relative to the shoe. The dewatering device has a curvature which is less than, and opposite to that of the curved shoe. A second portion of water is removed from the stock through the second wire during movement of the stock and the wires over the dewatering device. A further dewatering shoe is between the dewatering device and the downstream end of the forming section, and cooperates with the second wire and is on the same side of the wires as the shoe. The further shoe is connected to a source of partial vacuum such that a third portion of water is removed from the stock through the second wire during movement of the stock and the wires over the further shoe.

6 Claims, 2 Drawing Sheets

TWIN WIRE FORMING APPARATUS

BACKGROUND OF THE INVENTION

1. Field of the Invention

The present invention relates to a forming apparatus and a method for forming a web from stock having an ash content above 20%. More particularly, the present invention relates to a forming apparatus using a high ash content stock in which the resultant web is super calendered in order to provide a printable surface thereon.

2. Information Disclosure Statement

In the papermaking art it is known to supply a high ash content stock from a headbox onto a generally horizontally disposed forming wire. The arrangement is such that water initially drains downward from the stock through the wire. A top wire cooperates with the forming wire downstream relative to the initial formation section and a suction box within the top wire draws water upwardly away from the stock so that a web having generally uniform surface characteristics on both sides thereof is formed.

Nevertheless, as machine speeds have increased, the aforementioned initial forming section and subsequent top wire removal has resulted in a certain amount of two sidedness in the resultant web. Two sidedness in the present specification means that the surface characteristics of one surface of the resultant web is substantially different from the surface characteristics of the opposite surface of the web. Such two sidedness causes problems when both sides of the resultant web are to be printed thereon.

Machine speeds in the region of 1,600 meters per minute which is equivalent to 5,200 feet per minute are envisaged and at such speed, even removal or balanced removal of water within the stock from both surfaces thereof is essential.

Accordingly, the present invention provides a vertical former which includes a pair of wires which cooperate together to define therebetween a vertical forming section. A headbox is disposed closely adjacent to the lower or upstream end of the forming section so that the stock is ejected from the headbox upwardly into the forming section.

A curved shoe means is disposed immediately downstream relative to the upstream end of the forming section. Such curved shoe means has a very large radius of curvature within the range of 250 to 350 inches and preferably 300 inches. The arrangement is such that water is removed centrifugally away from the curved shoe means through a first wire, while a further portion of water is removed through the curved shoe means through the second wire.

A dewatering means is disposed downstream relative to the curved shoe means with the dewatering means having a radius of curvature which is opposite to the radius of the curvature of the curved shoe means. The dewatering means is structured such that the amount of water removed through the first wire by the dewatering means and by the curved shoe means is approximately equal to the volume of water removed through the second wire through the curved shoe means and through the second wire as the stock and wires move past the dewatering means.

Accordingly, the amount of water removed from the stock is evenly balanced as the stock is formed into a web so that the ash content or clay of filler within the stock is evenly distributed throughout the formed web.

Subsequently, when the formed web is super calendered, the resultant calendered web exhibits surface characteristics similar to those of a coated web.

More particularly the resultant web is known in the art as super calendered Roto paper and super calendered Offset paper. Such papers contain mechanical pulp and clay fillers. The level of the fillers is higher than with normal paper production and may be in the region of 20 to 50 percent ash.

The Aforementioned web when super calendered has a high gloss together with a smooth printing surface which gives a very superior product which in many ways is comparable to a coated paper.

Therefore, the present invention provides a paper which requires no coating.

The prior production of the aforementioned supercalendered high ash content papers has been limited by forming speed, level of clay fillers and the dissimilarity of the surfaces or the resultant web.

The super calendering former of the present invention over comes the limitations of speed and can form sheets with a 31% filler level whereas current machines have a maximum of between 26 and 28% filler level. The present invention provides a sheet in which both sides thereof have very similar and even surface characteristics. The ash content at the respective surfaces thereof being approximately the same.

The present invention provides a curved shoe means which may have three blades approximately six inches wide in a machine direction with a spacing of approximately 2 inches between each blade. Such spacing of the three blades or shoes combined with the very large radius of curvature of the curved shoe means gives low intensity forming pulses to the stock so that the stock is gently dewatered during the initial or upstream portion of the forming section.

Therefore, it is a primary objective of the present invention to provide a forming apparatus which overcomes the aforementioned disadvantages of the prior art proposals and which makes a considerable contribution to the art of forming a web from stock.

Another object of the present invention is the provision of a web from a high ash content stock such that during subsequent supercalendering of the resultant web, even or similar surface characteristics of the web on both sides thereof are attained.

Other objects and advantages of the present invention will be readily apparent to those skilled in art by a consideration of the detailed description contained herein after taken in conjunction with the annexed drawings.

SUMMARY OF THE INVENTION

The present invention relates to a forming apparatus and method for forming a web from stock having an ash content above 20%.

The forming apparatus includes a headbox for projecting a stream of the stock and a first and second endless looped forming wire which cooperate together to define therebetween a forming section having an upstream and a downstream end. The upstream end of the forming section is disposed closely adjacent to the headbox such that the stream of stock is directed into the upstream end of the forming section. The curved shoe means is disposed immediately downstream relative to the upstream end of the forming section. The second wire is disposed between the first wire and the curved shoe means. The arrangement is such that a first portion of water is removed through the first wire when the wires and the stock move over the curved shoe means.

A dewatering means is disposed between the curved shoe means and the downstream end of the forming section. The dewatering means cooperates with the first wire and is disposed on the opposite side of the wires relative to the curved shoe means. The dewatering means has a radius of curvature which is less than the curvature of the curved shoe means. Also, the curvature of the dewatering means is in an opposite sense to the curvature of the curved shoe means. The arrangement is such that a second portion of water is removed from the stock through the second wire during movement of the stock and the wires over the dewatering means.

A further dewatering shoe is disposed between the dewatering means and the downstream end of the forming section. The further shoe cooperates with the second wire and is disposed on the same side of the wires as the shoe means. The further shoe is connected to a source of partial vacuum such that a third portion of water is removed from the stock through the second wire during movement of the stock and the wires over the further shoe. The arrangement is such that from the upstream to the downstream end of the forming section, water is progressively removed from the stock through both wires so that two sidedness of the resultant web is minimized while maintaining maximum retention of the ash within the web.

Many modifications and variations of the present invention will be readily apparent to those skilled in the art by a consideration of the detailed description contained hereinafter taken in conjunction with annexed drawings. However, such modifications and variations fall within the spirit and scope of the present invention as defined by the appended claims.

BRIEF DESCRIPTION OF THE DRAWINGS

Similar reference characters refer to similar parts throughout the drawings.

DETAILED DESCRIPTION OF THE DRAWINGS

Figure 1:
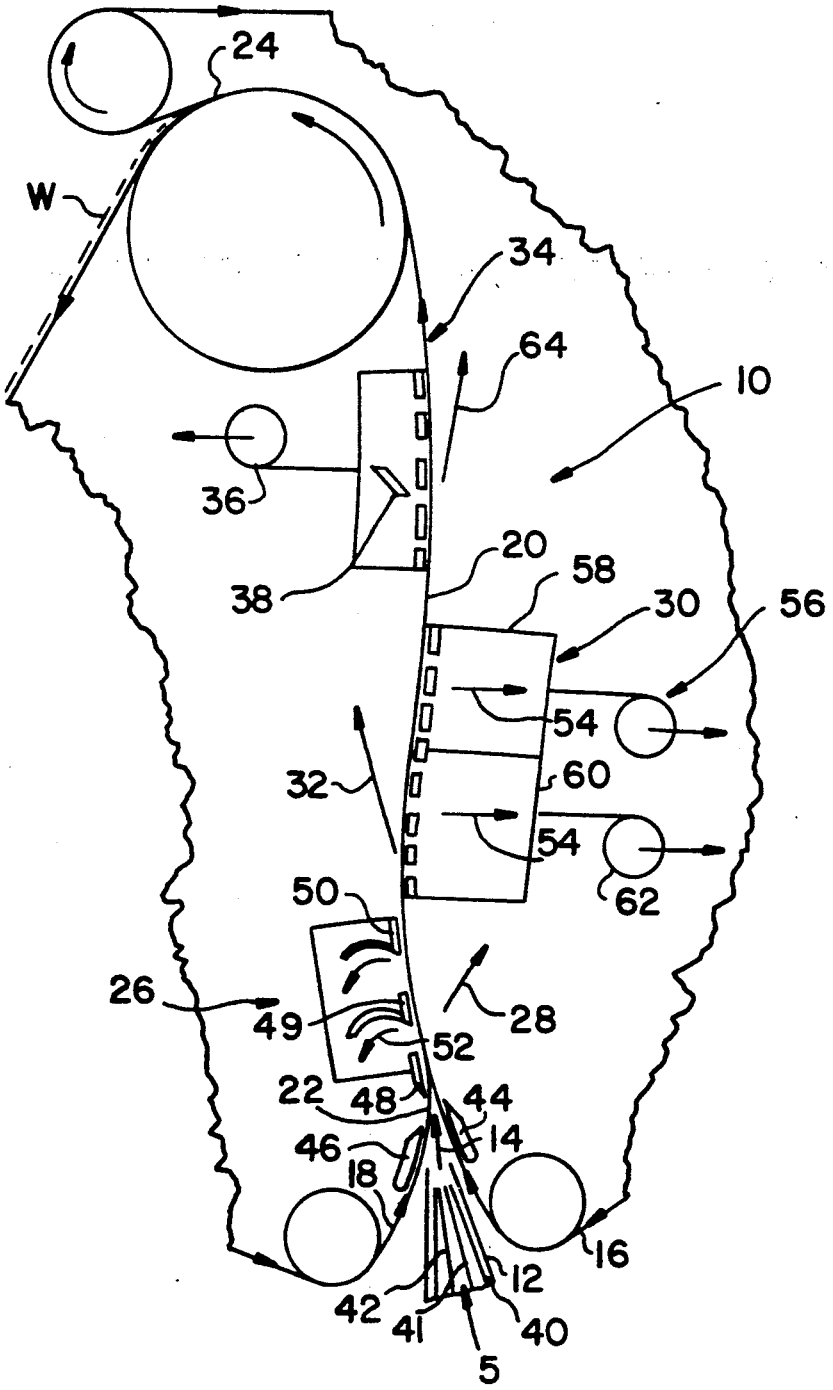
FIG. 1 is a side elevation of view of the forming apparatus according to the present invention.

FIG. 1 is a side elevation view of a forming apparatus generally designated 10 according to the present invention for forming a web W from stock S having an ash content of at least 20%. The apparatus 10 includes a headbox 12 for ejecting a stream 14 of the stock S.

A first and second endless looped forming wire 16 and 18 respectively cooperate together to define therebetween a forming section 20 having an upstream and a downstream end 22 and 24 respectively. The upstream end 22 is disposed closely adjacent to the headbox 12 such that the stream 14 of stock S is directed into the upstream end 22 of the forming section.

Curved shoe means generally designated 26 is disposed immediately downstream relative to the upstream end 22 of the forming section 20. The second wire 18 is disposed between the first wire 16 and the curved shoe means 26. The arrangement is such that a first portion of water is removed through the first wire 16 when the wires 16 and 18 and the stock S move over the shoe means 26.

A dewatering means generally designated 30 is disposed between the shoe means 26 and the downstream end 24 of the forming section 20. The dewatering means 30 cooperates with the first wire 16 and is disposed on the opposite side of the wires 16 and 18 relative to the curved shoe means 26. The dewatering means 30 has a radius of curvature which is less than the radius of the curvature of the curved shoe 26. Also, the curvature of the dewatering means 30 is in an opposite sense to the curvature of the curved shoe means 26.

The arrangement is such that a second portion of water as indicated by the arrow 32 is removed from the stock S through the second wire during movement of the stock S over the dewatering means 30.

A further dewatering shoe generally designated 34 is disposed between the dewatering means 30 and the downstream end 24 of the forming section 20. The further shoe 34 cooperates with the second wire 18 and is disposed on the same side of the wires 16 and 18 as the curved shoe means 26. The further shoe 34 is connected to a source of partial vacuum 36 such that a third portion of water as indicated by the arrow 38 is removed from the stock S through the second wire 18 during movement of the stock S and wires 16 and 18 over the further shoe 34. The arrangement is such that from the upstream to the downstream end 22 and 24 respectively of the forming section 20, water is progressively removed from the stock S through both wires 16 and 18 so that two sidedness of the resultant web is minimized while maintaining maximum retention of the ash within the web.

As shown in FIG. 1, the headbox 12 includes a plurality of trailing elements 40, 41 and 42 for controlling the turbulence of the stock S within the headbox 12.

As shown in FIG. 1, the forming apparatus 10 also includes a first and second turning bar 44 and 46 respectively disposed within the first and second looped wires 16 and 18 respectively for guiding the wires 16 and 18 into close proximity relative to the headbox 12. The arrangement is such that the distance between the headbox 12 and upstream end 22 of the forming section 20 is minimized.

The curved shoe means 26 according to the present invention has a radius of curvature within the range of 250 to 350 inches and in a preferred embodiment of the present invention, the radius of curvature of the curved shoe means 26 is 300 inches.

According to the present invention, the curved shoe means 26 may be in the form of a solid shoe but preferably and as shown in FIG. 1 the curved shoe means 26 includes a plurality of shoes 48, 49 and 50.

Figure 2:
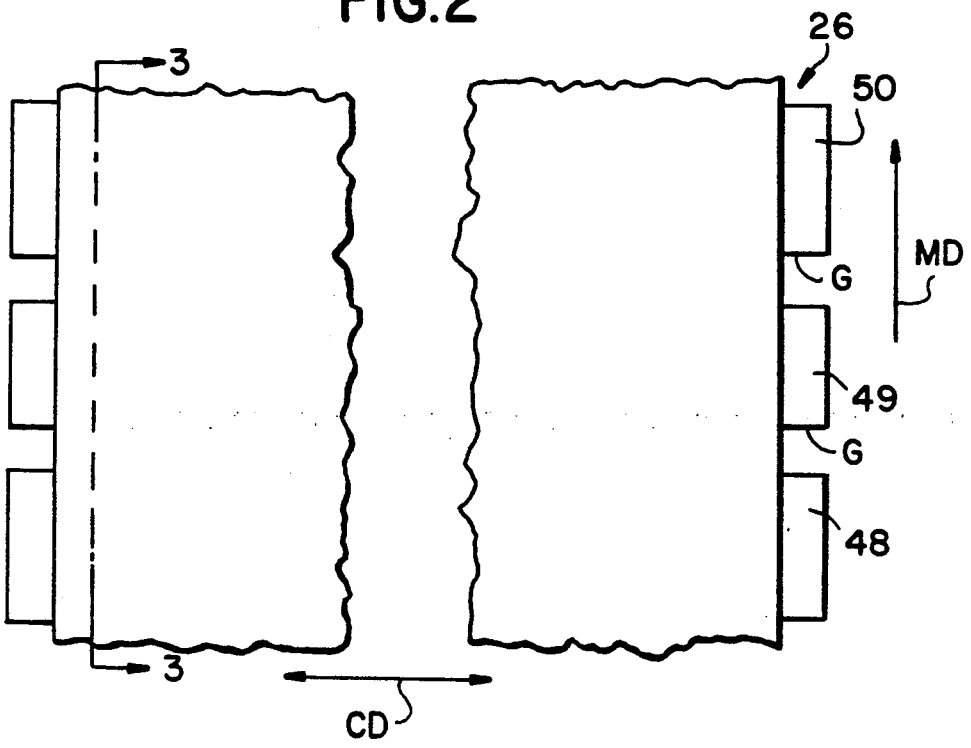
FIG. 2 is an enlarged plan view of the curved shoe means shown in FIG. 1 showing the spacing of the shoes thereof.

FIG. 2 is an enlarged plan view of the curved shoe means 26 and shows the plurality of shoes 48 to 50. Each shoe of plurality of the shoes 48 to 50 extends in a cross machine direction as indicated by the arrow CD with each shoe of the plurality of shoes 48 to 50 defining a gap G between adjacent shoes in a machine direction as indicated by the arrow MD.

Preferably the plurality of shoes 48 to 50 are of ceramic material.

Figure 3:
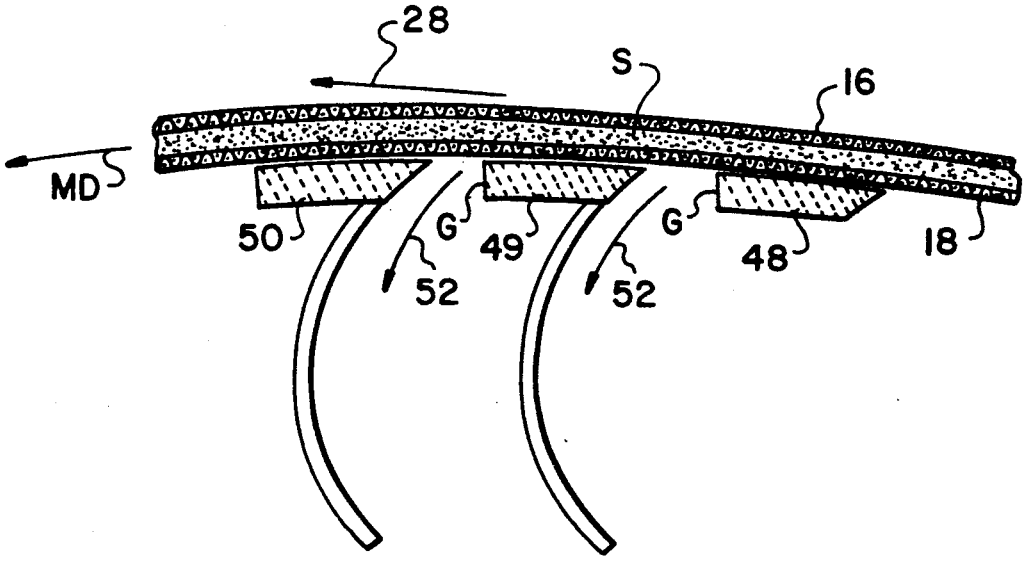
FIG. 3 is a sectional view taken on the line 3—3 shown in FIG. 2.

FIG. 3 is a sectional view taken on the line 3—3 of FIG. 2 and shows a further portion of water as indicated by the arrows 52 being removed from the stock S through the second wire 18. The further portion of water 52 is removed between each gap G defined between the adjacent shoes.

The further portion of water 52 and the second portion of water 32 as shown in FIG. 1 is substantially equal in volume to the first portion of water 28 and a fourth portion of water as indicated by the arrow 54 shown in FIG. 1 removed through the first wire 16 during movement of the stock S and the wires 16 and 18 over the dewatering means 30.

The arrangement is such that ash within the stock S is evenly distributed on both sides of the web W so that during subsequent supercalendering of the web W, the resultant web exhibits enhanced printing characteristics on both sides thereof.

The dewatering means 30 is connected to a source of partial vacuum generally is designated 56 as shown in FIG. 1. The source of partial vacuum 56 assists in the removal of the fourth portion of water 54 from the stock S.

More particularly, as shown in FIG. 1 the dewatering means 30 further includes an upstream and a downstream portion 58 and 60 respectively. The upstream portion 60 is connected to a lower source of partial vacuum 62 than the downstream portion 58 for enhancing the progressive removal of the fourth portion of water 54 from the stock S moving through the forming section 10.

The further dewatering shoe 34 as shown in FIG. 1 is a curved shoe. The further shoe 34 has a radius of curvature which is in the same sense of direction as the radius of curvature of the curved shoe means 26. The arrangement is such that a fifth portion of water indicated by the arrow 64 is removed through the first wire 16 during movement of the stock S and the wires 16 and 18 over the further shoe 34.

In operation of the apparatus according to the present invention, a high ash content stock S is ejected from the headbox 12 vertically into the upstream end 22 of the forming section 20.

A first portion of water 28 is removed from the stock through the first wire 16 during movement of the stock and the wires over the curved shoe 26.

A second portion of water is removed from the stock through the second wire 18 during movement of the stock and the wires over the dewatering device 30.

A third portion of water is removed from the stock through the second wire 18 during movement of the stock and the wires over the further dewatering shoe 34. The further dewatering shoe 34 is disposed within the second looped forming wire and has a radius of curvature in the same direction as the curvature of the curved shoe means. Such curvature is opposite to the curvature of the dewatering shoe so that as the stock progresses from the upstream to the downstream end of the forming section, water is evenly and progressively removed from both sides of the web so that during a subsequent supercalendering of the web, the subsequent supercalendered web exhibits certain characteristics including smoothness and gloss which enable printing on both sides thereof.

The present invention provides a forming apparatus which enables the production of a supercalendered web from high ash content stock at extremely high speeds without the need for any coating being applied thereon.

What is claimed is:

1. A forming apparatus arrangement for forming a web from stock having an ash content above 20 percent, said apparatus comprising:

a headbox for vertically ejecting a stream of the stock;

first and second endless looped forming wires cooperating together to define therebetween a vertical forming section having an upstream and a downstream end, said upstream end being disposed closely adjacent to said headbox such that said stream of stock is directed vertically upwardly into said upstream end of said forming section;

curved shoe means cooperating with said second wire, said shoe means being disposed immediately downstream relative to said upstream end of said forming section, said second wire being disposed between said first wire and said shoe means, the arrangement being such that a first portion of water is removed through said first wire when said wires and the stock move over said shoe means;

a stationary dewatering means disposed between said shoe means and said downstream end of said forming section, said dewatering means cooperating with said first wire and being disposed on the opposite side of said wires relative to said shoe means, said dewatering means having a radius of curvature which is less than that of said curved shoe means, said dewatering means having a curvature in an opposite sense than the curvature of said curved shoe means, the arrangement being such that a second portion of water is removed from the stock through said second wire during movement of the stock and said wires over said dewatering means;

a further dewatering shoe disposed between said dewatering means and said downstream end of said forming section, said further shoe cooperating with said second wire and being disposed on the same side of said wires as said shoe means, said further shoe being connected to a source of partial vacuum such that a third portion of water is removed from the stock through said second wire during movement of the stock and said wires over said further shoe, the arrangement being such that from said upstream end to said downstream end of said forming section, water is progressively and evenly removed from the stock through both wires, so that two-sidedness of the resultant web is minimized while maintaining maximum retention of the ash within the web;

said further dewatering shoe being a curved shoe;

said further shoe having a radius of curvature in the same sense as the radium of curvature of said curved shoe means such that a fifth portion of water is removed through said first wire during movement of the stock and wires over said further shoe; and said forming apparatus further including:

a first and second turning bar disposed within said first and second looped wires, respectively, for guiding said wires into close proximity relative to said headbox, so that the distance between said headbox and said upstream end of said forming section is minimized;

said curved shoe means including:

a plurality of shoes, each shoe of said plurality of shoes extending in a cross-machine direction, each shoe of said plurality of shoes defining a gap between an adjacent shoe in a machine direction, the arrangement being such that a further portion of water is removed from the stock through said second wire, said further portion of water being removed between said gap defined between said adjacent shoes; and said further portion of water and said second portion of water being substantially equal in volume to said first portion of water and a fourth portion of water removed through said first wire during movement of the stock and said wires over said dewatering means, the arrangement being such that ash within the stock is evenly distributed on both sides of the web so that during a subsequent supercalendering of the web, the resultant web exhibits enhanced printing characteristics on both sides thereof.

2. A forming apparatus as set forth in claim 1 wherein said headbox further includes:

a plurality of trailing elements for controlling the turbulence of the stock within said headbox.

3. A forming apparatus as set forth in claim 1 wherein said curved shoe means has a radius of curvature within the range 250–350 inches.

4. A forming apparatus as set forth in claim 1 wherein said plurality of shoes are of ceramic material.

5. A forming apparatus as set forth in claim 1 wherein said dewatering means is connected to a source of partial vacuum for assisting removal of said fourth portion of water from the stock.

6. A forming apparatus as set forth in claim 5 wherein said dewatering means includes an upstream and a downstream portion, said upstream portion being connected to a lower source of partial vacuum than said downstream portion for enhancing the progressive removal of said fourth portion of water from the stock moving through said forming section.

* * * * *

UNITED STATES PATENT AND TRADEMARK OFFICE

CERTIFICATE OF CORRECTION

PATENT NO. : 5,201,999

DATED : April 13, 1993

INVENTOR(S) : Roderic Field, et al

It is certified that error appears in the above-indentified patent and that said Letters Patent is hereby corrected as shown below:

On the title page, In the Abstract line 2, after "has", insert --an--.

Column 2, line 27, "being" should read --is--.
Column 4, line 58, "the" should be added between "of" and "plurality"
Column 5, line 16, "is" should be deleted
Column 6, line 49, "radium" should read --radius--.

Signed and Sealed this

Twenty-ninth Day of March, 1994

Bruce Lehman

*Attest:*

BRUCE LEHMAN

*Attesting Officer*

*Commissioner of Patents and Trademarks*